US009382697B2

(12) United States Patent
Byrne

(10) Patent No.: US 9,382,697 B2
(45) Date of Patent: Jul. 5, 2016

(54) FIRE HYDRANT CLEANING DEVICE

(71) Applicant: Terrence K. Byrne, Lexington, OH (US)

(72) Inventor: Terrence K. Byrne, Lexington, OH (US)

( * ) Notice: Subject to any disclaimer, the term of this patent is extended or adjusted under 35 U.S.C. 154(b) by 406 days.

(21) Appl. No.: 13/894,905

(22) Filed: May 15, 2013

(65) Prior Publication Data

US 2013/0306104 A1 Nov. 21, 2013

Related U.S. Application Data

(60) Provisional application No. 61/648,300, filed on May 17, 2012, provisional application No. 61/794,920, filed on Mar. 15, 2013.

(51) Int. Cl.

| | |
|---|---|
| ***A46B 3/08*** | (2006.01) |
| ***A46B 7/10*** | (2006.01) |
| ***A46B 13/02*** | (2006.01) |
| ***A46B 7/04*** | (2006.01) |
| ***A46B 9/06*** | (2006.01) |
| ***B08B 1/04*** | (2006.01) |
| ***E03B 9/18*** | (2006.01) |

(52) U.S. Cl.

CPC ... *E03B 9/18* (2013.01); *A46B 3/08* (2013.01); *A46B 7/046* (2013.01); *A46B 7/10* (2013.01); *A46B 13/02* (2013.01); *A46B 9/06* (2013.01); *A46B 2200/3013* (2013.01); *A46B 2200/3073* (2013.01); *A46B 2200/3093* (2013.01); *B08B 1/04* (2013.01)

(58) Field of Classification Search

CPC ..... A46B 13/001; A46B 9/026; A46B 9/028; A46B 7/10; A46B 2200/3013; E01H 1/005; B08B 1/002; B08B 1/003; B08B 1/005; B08B 1/006; B08B 1/04

See application file for complete search history.

(56) References Cited

U.S. PATENT DOCUMENTS

| | | | | |
|---|---|---|---|---|
| 2,756,446 | A * | 7/1956 | Chittum | A46B 13/04 15/29 |
| 3,036,320 | A * | 5/1962 | Behrendt | 15/21.1 |
| 3,150,888 | A | 9/1964 | Parker | |
| 3,922,745 | A | 12/1975 | Lehman | |

(Continued)

FOREIGN PATENT DOCUMENTS

| | | | |
|---|---|---|---|
| AT | 202004013311 U1 * | 10/2004 | E01H 1/005 |
| DE | 1248084 | 8/1967 | |

(Continued)

OTHER PUBLICATIONS

Machine translation: DE 202004013311 U1; Schloffer, J.; 2004.*

(Continued)

*Primary Examiner* — Michael Kornakov
*Assistant Examiner* — Natasha Campbell
(74) *Attorney, Agent, or Firm* — Fay Sharpe LLP

(57) ABSTRACT

A cleaning apparatus for cleaning an associated object includes a motor and an output drive shaft powered by the motor. A cleaning attachment is coupled for rotational movement with the output drive shaft and has an axis of rotation. The cleaning attachment includes a housing having an outer surface and an inner surface. A plurality of elongated cleaning members is mounted to the inner surface of the housing. The apparatus can be employed as a cleaning implement for fire hydrants or other stationary objects. A mechanized method for cleaning stationary objects is also disclosed.

20 Claims, 13 Drawing Sheets

(56) References Cited

U.S. PATENT DOCUMENTS

| | | | | |
|---|---|---|---|---|
| 4,134,174 | A | 1/1979 | Flynn et al. | |
| 4,311,274 | A | 1/1982 | Neal | |
| 4,502,175 | A | 3/1985 | Hillis | |
| 4,532,886 | A | 8/1985 | Bouchard | |
| 4,862,549 | A * | 9/1989 | Criswell | A46B 9/02 15/104.04 |
| 4,932,354 | A | 6/1990 | Kistner | |
| 5,010,632 | A | 4/1991 | Gardner | |
| 5,392,593 | A | 2/1995 | Emery | |
| 5,647,084 | A * | 7/1997 | Still et al. | 15/104.92 |
| 5,987,699 | A | 11/1999 | Nakamura et al. | |
| 6,013,138 | A | 1/2000 | Sinz | |
| 6,047,531 | A | 4/2000 | Bryan, III | |
| 6,082,631 | A | 7/2000 | Aslakson | |
| 6,126,766 | A | 10/2000 | Hunter, Jr. | |
| 6,132,509 | A | 10/2000 | Kuschnereit | |
| 6,237,177 | B1 | 5/2001 | Richardson | |
| 6,481,448 | B2 | 11/2002 | Mathieu | |
| 6,550,692 | B1 | 4/2003 | Schacht | |
| 6,640,528 | B1 | 11/2003 | Rowland | |
| 7,716,782 | B2 | 5/2010 | Terrien et al. | |
| 7,934,574 | B2 | 5/2011 | Seino | |
| 2003/0064668 | A1 | 4/2003 | Mrak | |
| 2005/0102778 | A1 | 5/2005 | Gregerson | |
| 2007/0080110 | A1 * | 4/2007 | Lombardi | B01D 21/0003 210/532.2 |
| 2012/0186032 | A1 | 7/2012 | Donohue et al. | |

FOREIGN PATENT DOCUMENTS

| | | | |
|---|---|---|---|
| DE | 3918199 | | 12/1990 |
| FR | 2703376 | | 10/1994 |
| GB | 2 306 306 | A | 5/1997 |
| GB | 2434970 | A * | 8/2007 |
| JP | 05-104068 | | 4/1993 |
| WO | WO 97/00358 | | 1/1997 |
| WO | WO 2005/021165 | | 3/2005 |

OTHER PUBLICATIONS

International Preliminary Report on Patentability of International Application No. PCT/US2013/041356 dated Nov. 27, 2014 (7 pages).

http://www.giantmandr.com/municipal.html, Hydrant Painting, 1 page, Apr. 17, 2012.

http://wvvw.ehow.com/how_4803720-start-fire-hydrant-painting-business.html, How to Start a Fire Hydrant Painting Business, 4 pages, Apr. 17, 2012.

Fire Hydrant Inspection and Maintenance Manual, City of Defiance Water Division, Nov. 24, 2009.

International Search Report of International Application No. PCT/US2013/041356 dated Sep. 27, 2013.

Written Opinion of International Application No. PCT/US2013/041356 dated Sep. 27, 2013.

* cited by examiner

FIRE HYDRANT CLEANING DEVICE

This application claims priority from Provisional Application Ser. No. 61/648,300 which was filed on May 17, 2012 and from Provisional Application Ser. No. 61/794,920 which was filed on Mar. 15, 2013. The subject matter of each of these applications is incorporated hereinto in its entirety.

BACKGROUND

Fire hydrants or fire plugs are employed by nearly all municipalities. As with other infrastructure, fire hydrants need to be maintained. The intent of a fire hydrant maintenance program is to keep hydrants in a ready condition through flushing, inspection, lubricating, cleaning and painting. One of the more difficult aspects of a fire hydrant maintenance program is the process of cleaning the hydrant or plug. This is often accomplished by pressure washing or sandblasting the fire hydrant in order to remove dirt, grease and flaking paint from the outer surface of the hydrant. In order to protect the surroundings, a plastic shower cap may be used, along with a small tarp placed over the adjacent sidewalk or lawn. The cleaning process also requires a generator and an air compressor for the pressurized fluid or sand that is being applied to clean the hydrant not to mention a supply of the fluid or sand.

Another way of cleaning the fire hydrant is by a worker manually using a hand held wire brush to remove flaking paint, grease, dirt and the like from the outer surface of the accessible portion of the fire hydrant. As is easily recognized, such work is laborious and time consuming. A single worker is not able to clean very many hydrants or fire plugs in a single day. In order to clean the significant number of fire hydrants which even a midsize municipality employs in a reasonably limited time period, the municipality would need to employ a number of workers for the task.

It would be advantageous to provide a rotary brush system to clean fire hydrants, with the brush system including bristles that contact or are capable of contacting all of the above ground exterior surface of a hydrant or plug. The system could be mounted to a motor vehicle so that an effective and quick cleaning of the fire hydrant can take place by a single worker without the need for ancillary equipment such as generators, air compressors, a supply of cleaning material and the like and without needing multiple personnel during the cleaning process. Such a motorized cleaning system would also eliminate the need for multiple workers to be employed in the fire hydrant cleaning process, as a mechanized system would be significantly faster in cleaning a fire hydrant than would be a manual process for doing so. In other words, it would be advantageous to provide a one man cleaning system in order to reduce the costs to the municipality for cleaning fire hydrants.

BRIEF DESCRIPTION

In accordance with one aspect of the present disclosure, a cleaning apparatus for cleaning an associated object comprises a motor, an output drive shaft powered by the motor and a cleaning attachment coupled for rotational movement with the output drive shaft and having an axis of rotation. The cleaning attachment comprises a housing including an outer surface and an inner surface and a plurality of elongated cleaning members mounted to the inner surface of the housing.

In accordance with another aspect of the present disclosure, provided is a cleaning apparatus for the on-site cleaning of a stationary object. The cleaning apparatus comprises a housing, including an interior surface. A plurality of elongated cleaning members is mounted to the housing interior surface. A motor is provided for rotating the housing along a generally vertical axis in relation to the associated stationary object.

In accordance with still another aspect of the present disclosure, provided is a method for cleaning a stationary object. The method comprises providing a housing equipped with elongated cleaning members located on an interior surface thereof. The housing is lowered over the stationary object. Thereafter, the housing is rotated and an exposed surface of the stationary object is contacted with the elongated cleaning members.

DETAILED DESCRIPTION

Figure 1:
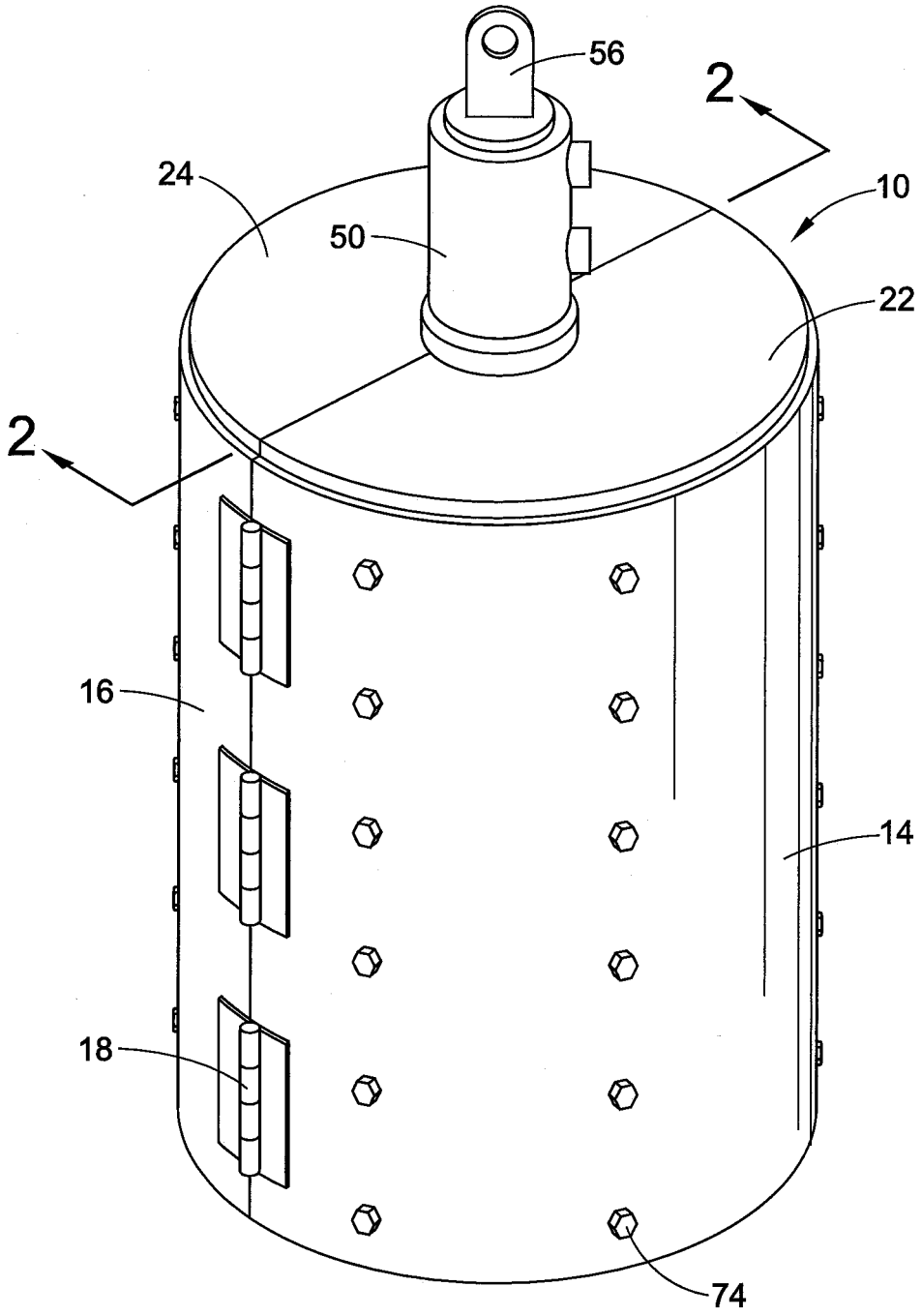
FIG. 1 is a perspective view of a housing for a fire hydrant cleaning system according to a first embodiment of the present disclosure.

With reference now to FIG. 1, in one embodiment, the present disclosure pertains to a housing 10 which comprises a first clam shell half 14 and a second clam shell half 16 that can be selectively opened or closed via a hinge or set of hinges 18. Supported on the first half 14 is a first top wall section 22 and supported on the second half 16 is a second top wall section 24. To this end, one or more flanges 28 (see FIG. 2) may be employed to support the top walls in place on the side walls or housing halves. Weld joints as at 30 may be employed to secure the several metal wall or housing sections to each other. As may be evident from e.g. FIG. 2, the housing 10 comprises a can-shaped cylindrical or barrel-shaped configuration with a closed top and an open bottom so that the housing can be lowered over or encircle the exposed portions of the stationary object which is meant to be cleaned.

Figure 3:
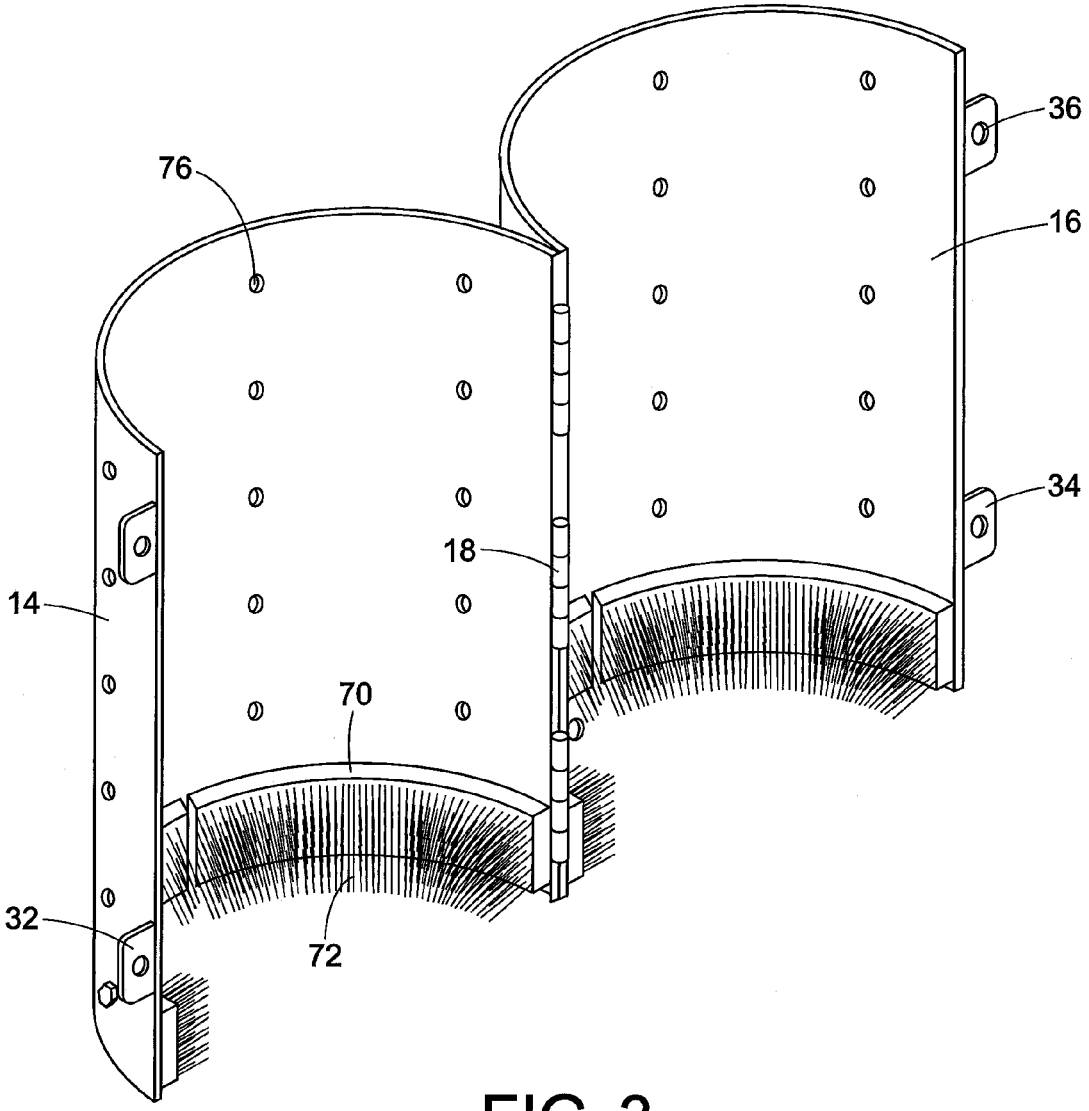
FIG. 3 is a perspective view of the housing of FIG. 1 with the housing being shown in an open condition and illustrating only one set of brush mounts.

With reference now to FIG. 3, the two clam shell halves 14 and 16 are there illustrated in an open position as permitted by hinge sections 18, but without the top wall portions 22 and 24. It can be seen that the clam shell halves 14 and 16 can be selectively secured in a closed position via cooperating locking tabs or brackets 32 and 34. Extending through the tabs are aligned apertures 36 which can accommodate conventional fasteners (not illustrated). In one embodiment, the clam shell halves are generally maintained in a closed position, as the fire hydrant cleaning system is moved from one hydrant to another. In another embodiment of the present disclosure, however, the clam shell halves can approach a fire hydrant in an open position and are closed around the fire hydrant, either manually or via conventional hydraulically operated piston and cylinder assemblies or the like.

With reference again to FIG. 2, a hydraulic motor 50 can be employed to selectively rotate the housing 10. The hydraulic motor is provided with inlet and outlet flow lines 52 and 54, as well as a support 56 to enable the motor 50 and the housing 10 to be mounted to a prime mover, such as a vehicle. In the illustrated embodiment, a mounting plate 60 is shown. While a flat mounting plate is depicted, this is done for the sake of simplicity. Generally speaking, an approximately two and a half inch (1.27 cm) diameter coupler is provided to allow the housing to be mounted to the hydraulic motor. A female receptacle may accommodate a round connecting member such as a bar. Other known shapes for the connecting member include a hexagon, a square or any other driven shaft extending from the hydraulic motor 50. It should be appreciated that other types of motors could also be employed to rotate the housing around the stationary object which is meant to be cleaned, descaled or otherwise prepared for subsequent painting operations.

Secured to an interior wall of the housing 10 are one or more mounting blocks 70. Each of these supports a plurality of elongated cleaning members 72. In one embodiment, the elongated cleaning members comprise bristles made of a suitable material such as metal wire or the like. In another embodiment, the elongated cleaning members comprise descaling needles. Such needles are known in the art and generally range in diameter from 2 mm to 4 or 5 mm and in some embodiments will have a length of 180 mm or more. Some descaling needles have a flat tip, while others are chisel tipped. The use of such needles for removing foreign substances from metal, wood, stone or the like is known. The needles are typically formed of drill rod or similar tough hard elastic steel. Descaling needles are known for removing scale from welds and for removing foreign substances from generally rigid surfaces. Normally, descaling needles are used in a reciprocating manner being propelled either pneumatically or with a reciprocating hammer.

In contrast, the instant disclosure pertains to the use of such elongated cleaning members, whether they be termed descaling needles or metal brush elements or the like in one or more blocks or support members, or otherwise rigidly attached to an interior surface of the housing 10 so as to selectively contact the exposed surfaces of a stationary object which is to be cleaned by the apparatus disclosed herein. In one embodiment, brush elements, made of a spring steel wire, are provided in a single length but with two different diameters. More particularly, the cleaning members can be 11 inches (27.94 cm) in length and can come in a larger diameter of 0.177 inches (0.45 cm) and a smaller diameter of 0.090 inches (0.23 cm).

Fasteners 74 extend through apertures 76 (see FIG. 3) in the housing halves 14 and 16 in order to selectively connect the mounting blocks 70 to the housing 10. It is apparent from FIG. 2 that mounting blocks are provided on the interior surfaces of not only the first and second clam shell halves 14 and 16, but also the top wall first and second sections 22 and 24. In this way, the entire outer above-ground surface or exposed areas of a hydrant can be accessed by the elongated cleaning members 72. In other words, the entire exposed surface of the fire hydrant or plug is surrounded by the elongated cleaning members. For the sake of simplicity, the elongated cleaning members will hereinafter be referred to as "bristles", it being understood that needles or other elongated cleaning members are also encompassed by the term "bristles."

Figure 2:
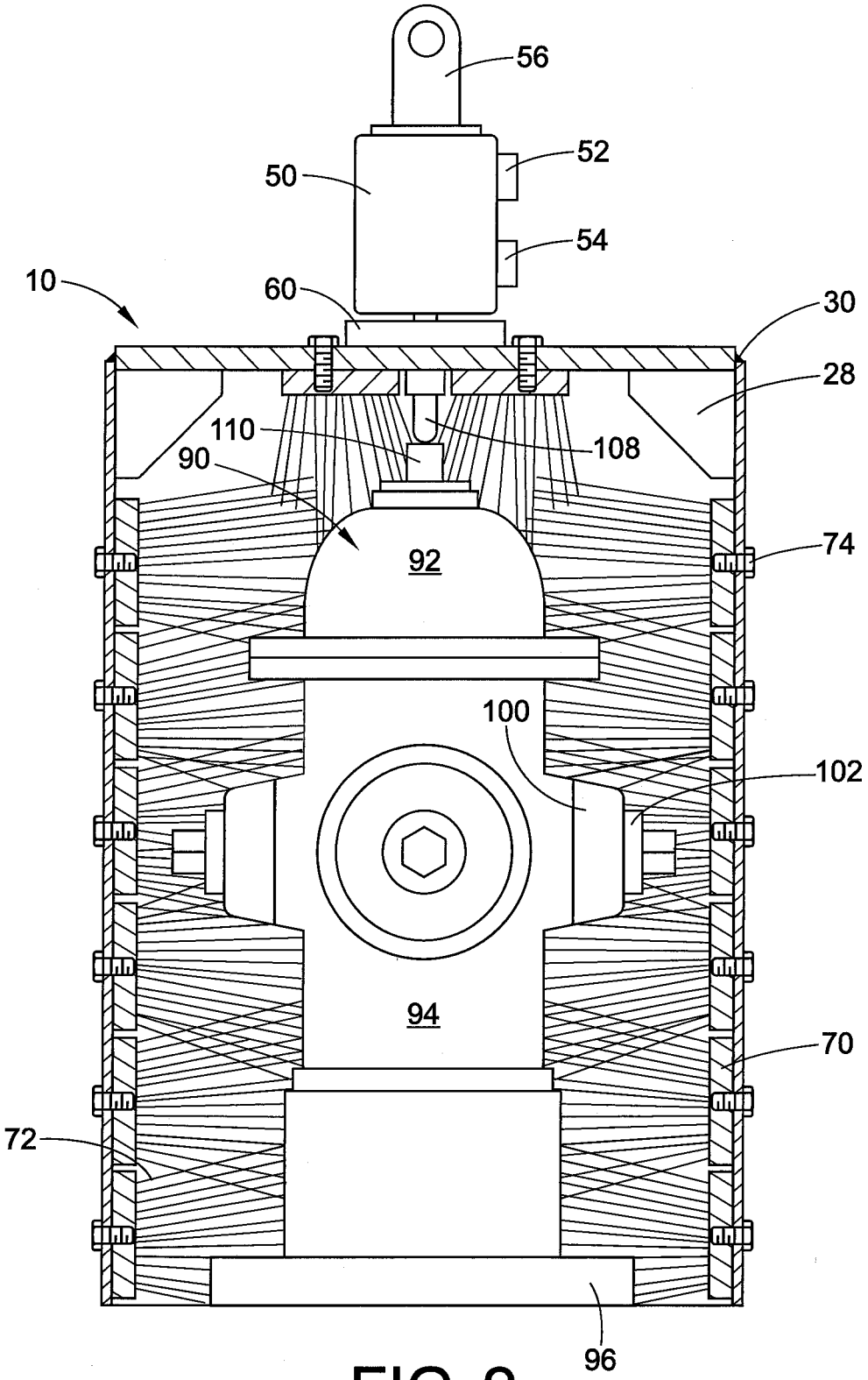
FIG. 2 is a cross sectional view of the housing along line 2-2 of FIG. 1.

In the embodiment illustrated in FIG. 2, a conventional hydrant 90 is shown. The hydrant includes a bonnet 92 and a barrel 94 mounted on a platform 96. The barrel 94 includes a plurality of nozzles 100, each being closed off by a nozzle cap 102. While one conventional hydrant 90 is illustrated in FIG. 2, it should be appreciated that the cleaning system disclosed herein can be adapted for use in connection with other known fire hydrant or fire plug designs which may have different shapes.

It should be appreciated that the bristles 72 are suitably sized so as to accommodate the several different diameter sections of the hydrant 90. As is evident from FIG. 2, the bristles can extend not just radially, but also somewhat axially so as to approach all of the outer or exposed surfaces of the hydrant 90. In this way, when the motor 50 rotates the housing 10, the bristles will contact and clean all of the exterior above-ground surface of the hydrant 90.

Figure 3A:
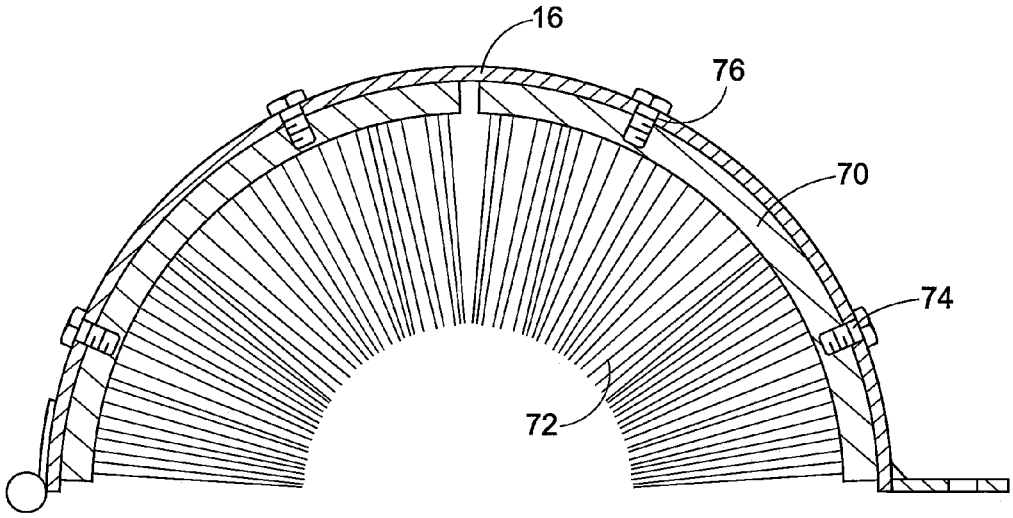
FIG. 3A is a top plan view of a section of the housing of FIG. 1 illustrating selectively detachable brush mounts.

With the embodiment illustrated in FIG. 3A, the brush mounts 70 can be detached and replaced when the bristles 72 can no longer function in order to adequately clean a fire hydrant. This can occur as the tips of the bristle 72 are abraded away during the cleaning process, particularly as the housing 10 is spun or rotated around the fire hydrant during the cleaning process. Moreover, the method of raising and lowering the housing 10 over the fire hydrant may sufficiently erode the bristles or bend them so that they are no longer capable of adequately cleaning the fire hydrant. Under such circumstances, the mount 70 in question would be removed as via fasteners 74 and replaced with a new bristle mount or section.

In another embodiment, the bristles 72 could be so sized as to accommodate the varying diameter sections of a fire hydrant. In this embodiment of the disclosure, the clam shell halves of the housing would be open as they approach a fire hydrant and would be closed around the fire hydrant when cleaning of the hydrant is desired. Subsequently, the clam shell halves would again be opened in order to allow the cleaning system to be displaced from the fire hydrant.

With reference again to FIG. 2, a contact finger 108 can depend from the top surface of the housing 10. The contact finger 108 is intended to serve as a spacing means for the housing 10 by contacting an operating nut 110 of the fire hydrant 90, thus placing the cleaning assembly at the right height in comparison to the elevation of the fire hydrant. Such placement allows the several bristles to operate to their maximum efficiency. Of course, it should be appreciated that other types of locating means could also be employed for this purpose.

Figure 4:
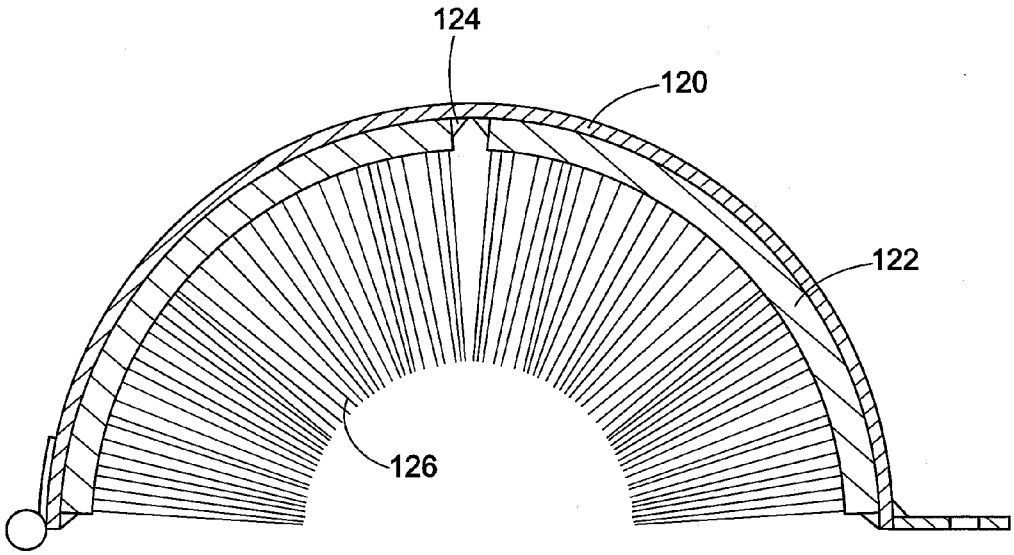
FIG. 4 is a top plan view of a housing section according to another embodiment of the present disclosure illustrating permanently fixed brush mounts.

With reference now to FIG. 4, in another embodiment of the present disclosure, a housing section or half 120 is provided with permanently secured brush mounts 122 as by weld joints 124. Each brush mount supports a plurality of bristles 126. In this embodiment, the housing halves are only employed for so long as the bristles remain functional to clean the fire hydrant. Thus, when the bristles are no longer useful, the entire housing half would be replaced, rather than replacing the brush mounts as in the embodiment illustrated in FIG. 3A.

While a brush mount of a particular size and configuration is illustrated in FIG. 3, it should be appreciated that mounts 70 of a variety of sizes and configurations could be employed as may be required or desirable for a particular cleaning function. Thus, the mounts could be taller or wider, narrower or shorter as may be needed or desired. Further, the mounts may not necessarily be rectangular, as is illustrated in FIG. 3. Instead, the mounts could be of any desired shape or configuration.

Further, bristles of a variety of sizes and configurations could be employed as may be required. In addition, bristles of different materials may be used. In other words, both metallic and non-metallic bristles are contemplated for use. If metallic bristles are employed, the bristles can have diameters of varying sizes. Thus, different gauge wire can be employed for the bristles if so desired or required. As might be expected, thousands of such elongated cleaning elements, bristles or descaling needles can be employed to cover the interior surface of the housing 10.

It should be appreciated that the housing 10 has to be of a suitable diameter and length so as to accommodate the fire hydrant or fire plug being cleaned. Thus, the height of the cylinder has to cover the total above ground height of the fire hydrant and the diameter of the housing needs to accommodate the maximum diameter of the fire hydrant being cleaned and provide additional space for brushes mounted to the interior surface of the housing. One conventionally known size of fire hydrant or fire plug has a height of about 29 inches (73.66 cm) and has a diameter of about 18 inches (45.72 cm). Needless to say, other fire hydrant diameters and heights can also be accommodated by suitably sizing the housing 10.

Figure 5:
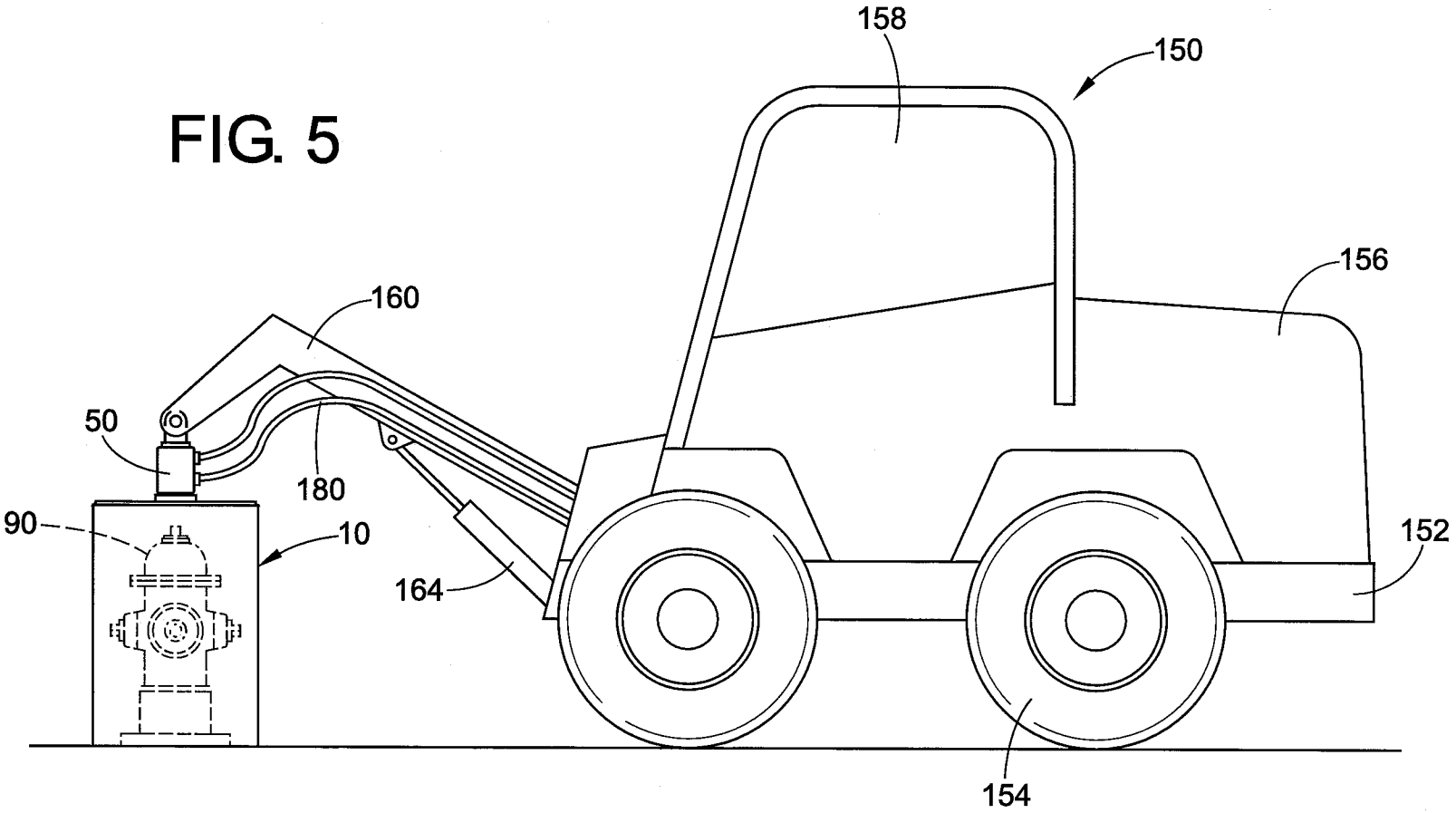
FIG. 5 is a side elevational view of a vehicle to which is connected a fire hydrant cleaning system according to the present disclosure, with a fire hydrant, illustrated in dashed lines, shown as being enclosed in a housing of the hydrant cleaning system.

With reference now to FIG. 5, a prime mover or vehicle 150 to which the cleaning system can be mounted includes a chassis 152 supported on wheels 154. Supported by the chassis 152 is an engine compartment 156, as well as a cab 158 in which an operator sits. Also supported on the chassis 152 is an arm 160 to which the housing 10 and motor 50 are mounted. The arm can be moved up and down via a known piston and cylinder assembly 164. As is evident from FIG. 5, hydraulic lines 180 can be provided in order to operate the hydraulic motor 50.

In the embodiment illustrated in FIG. 5, the prime mover 150 is in the form of a skid steer vehicle. These are adapted for use in many industrial, agricultural and landscaping applications where easy maneuverability, power lifting and transporting capabilities are required. The actuation of the piston and cylinder assembly 164 is controlled by the operator as is the actuation of the hydraulic motor 50. In this way, a single operator can control the cleaning of a fire hydrant.

In use, an operator sitting in the cab 158 of the vehicle 150 can approach a fire hydrant and lower the housing over the fire hydrant until the housing approaches a ground surface or otherwise encircles the fire hydrant. When the correct cleaning position of the housing is reached, the motor 50 is actuated in order to rotate the housing 10 and, hence, engage the bristles 72 against the outer surface of the hydrant 90. The length and thickness of the several elongated cleaning members or bristles is such as to allow for varying degrees of buckling and lateral deflection of the bristles when impacting a work surface, such as the outer surface of the hydrant 90. In other words, the ends of the bristles may splay out along the surface of the fire hydrant. As will be appreciated, the greater the deflection or splaying of the bristles, the less will be the intensity of the impact of the bristle tips against the outer surfaces of the fire hydrant. The length and flexibility of the elongated cleaning members enables a variation in the intensity of the impact of the cleaning members on the worked surface, i.e., the outer surface of the stationary object which is meant to be cleaned. It should be appreciated that the larger the amount of bristles in a given area, the more focused is the cleaning action on the fire hydrant or other stationary object, particularly if the bristles are not allowed to deflect or splay out. If desired, the force of a bundle of bristles can be intensified and confined to a smaller area. On the other hand, the more the cutting or working ends of the bristles are allowed to splay out or deflect, the more they are able to conform to the irregular outer surface of a fire hydrant or similar stationary object. In this way, the outer surface of the hydrant is cleaned or scoured in an efficient, rapid, and effective manner without the need for multiple personnel to handle the cleaning process and without the need for ancillary equipment, such as hoses, pumping equipment, power generators, cleaning fluids, sand and related material and equipment.

Once the cleaning process has been completed, the motor 50 is deactivated. The housing 10 can at that point be lifted away from the fire hydrant 90 via the arm 160. The vehicle can then be driven to the next adjacent hydrant to be cleaned. There, the process discussed above is again repeated.

In a further embodiment of the present disclosure a single piece housing can be contemplated in which bristles are either detachably mounted to the housing via mounts or permanently secured to the housing. It should be appreciated that with a single piece housing, the housing would need to be lowered over the fire hydrant meant to be cleaned and then lifted upwardly away from the fire hydrant when the cleaning process is complete. With a single piece housing and permanently mounted bristles, the entire housing would be replaced when the bristles are no longer effective to clean a fire hydrant. With a single piece housing and detachable bristles secured on mounting blocks or mounts, the mounts would be detached and replaced as necessary.

It should also be appreciated that multiple piece housings can be employed, such that the housing comprises three or more sections which are joined to each other, such as by hinges. In such a design, each housing section would have mounted thereto bristle mounts, either permanently or detachably.

In another embodiment, the vehicle 150 can support a boom assembly having multiple link sections in order to allow the housing 10 and motor 50 to be moved greater distances away from the vehicle 150.

Once the cleaning system as finished its task, the fire plug or fire hydrant is prepped for priming and painting. Generally, the hydrant is primed and subsequently painted in at least one color. Many hydrants are painted two colors and sometimes even three colors. The various colors that hydrants are painted may indicate the flow characteristics of the hydrant. Different colors may indicate different water flow capacities as in gallons per minute (gpm), with one color indicating more than 1,500 gpm (567.1 liters per minute or lpm) and various other colors indicating 1,000-1,500 gpm (3785.4-5678.1 lpm), 500-999 gpm (1892.7-3781.6 lpm) or less than 500 gpm (1892.7 lpm). In other words, the amount of water that can be withdrawn from the hydrant could be indicated by the color of at least the cap of the hydrant.

In still another embodiment, the vehicle can be provided with not only a cleaning implement supported on a first boom, but a painting implement supported on a second boom that is spaced from the first boom. In this way, a single vehicle could be used not only to clean the fire hydrant, but also to paint the fire hydrant after the cleaning process has finished.

It should be appreciated that the cleaning assembly disclosed herein with suitable modifications can also be employed to clean highway pylons, shoulder posts and the like, located adjacent to roads or paths which can be traversed by the vehicle 150.

It is believed that the cleaning apparatus can clean a stationary object, such as a fire hydrant or fire plug in about one minute. Thus, the fire hydrant is ready to be painted in about sixty seconds. Moreover, the expensive sand blasting process previously employed to clean fire hydrants before painting has been eliminated. Thus, the manual labor involved and the man hours necessary for cleaning fire hydrants has been greatly reduced. Further, hand and eye injuries to workers employing known cleaning processes have been greatly reduced or eliminated entirely. Moreover, the productivity of the maintenance personnel employing the cleaning apparatus according to the present disclosure is greatly increased.

Figure 6:
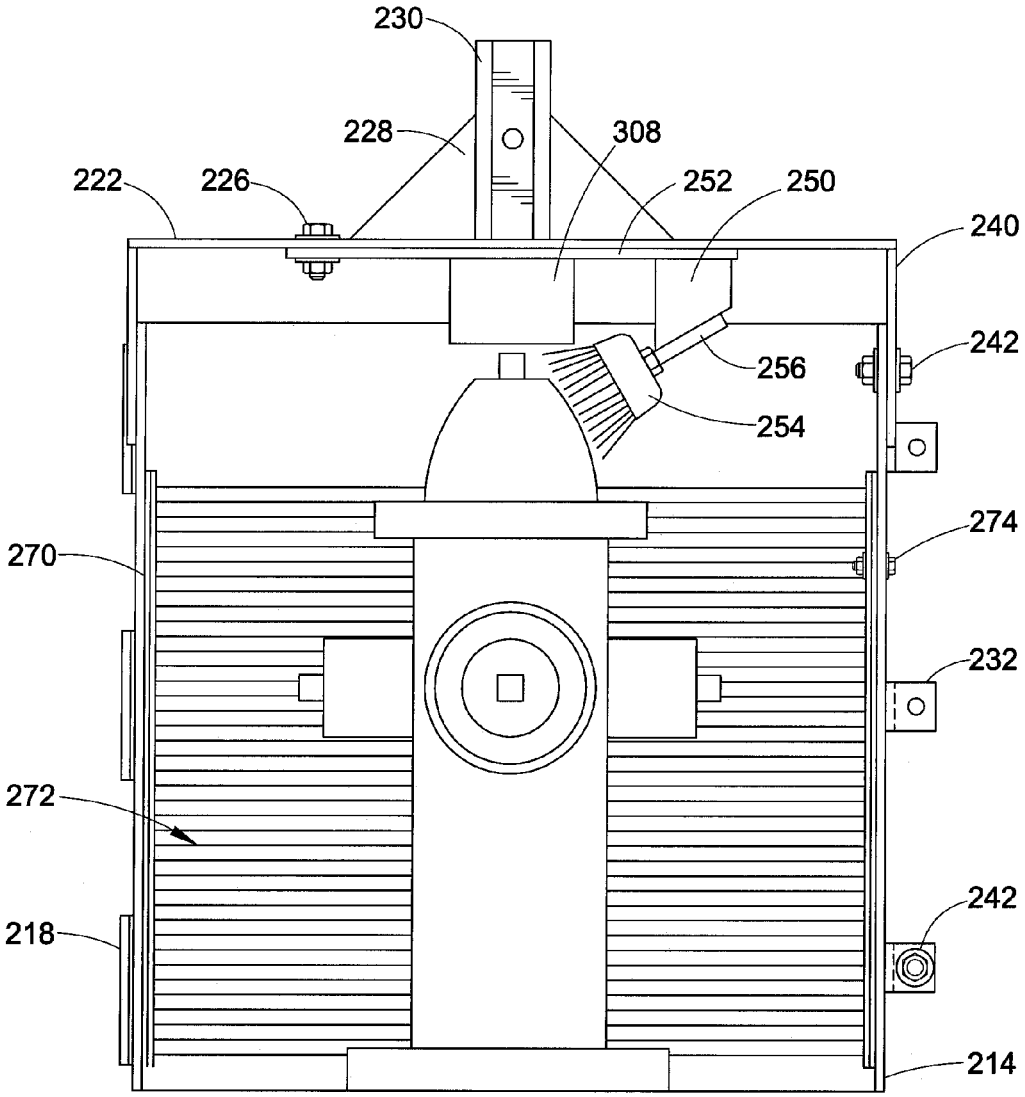
FIG. 6 is a side elevational view in cross section of a housing for a fire hydrant cleaning system according to a second embodiment of the present disclosure.
Figure 7:
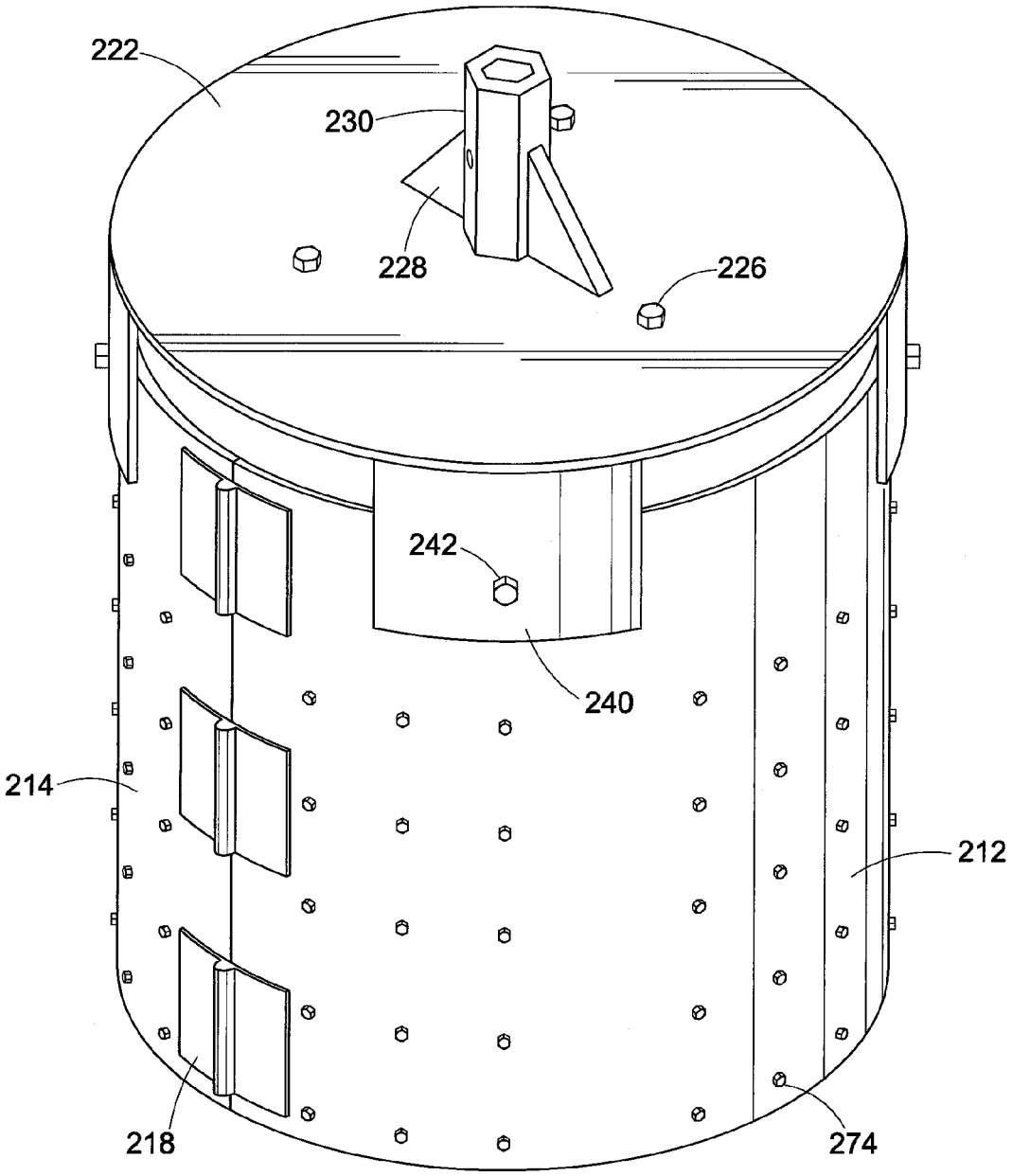
FIG. 7 is a perspective view of the fire hydrant cleaning system of FIG. 6.

With reference now to FIG. 6, another embodiment of the present disclosure is there illustrated. In this embodiment, a barrel shaped fire plug cleaning device includes a housing 210 comprising a first barrel half 212 (FIG. 7) and a second barrel half 214. Suitable hinges 218 connect the two barrel halves. A barrel cap 222 overlies the structure. In this embodiment, bolts 226 or similar fasteners are employed for mounting a plate 252 for a brush holder 250 to the barrel cap 222. Located on the exterior surface of the barrel cap 222 is an arbor attachment 230 which is mounted via arbor gussets 228. The arbor attachment is configured to connect to a suitable motor (not illustrated in this embodiment) for rotating the barrel in relation to the fire hydrant being cleaned.

In this embodiment, an arbor cup brush 254 is mounted via a threaded rod 256 to the brush holder 250. This is employed for cleaning the arbor of the fire hydrant. It should be appreciated that several such brushes can be employed. Each arbor cup brush is adjustable via the threaded rod 256 so as to accommodate variations in geometry of the fire hydrant component being cleaned.

Figure 9:
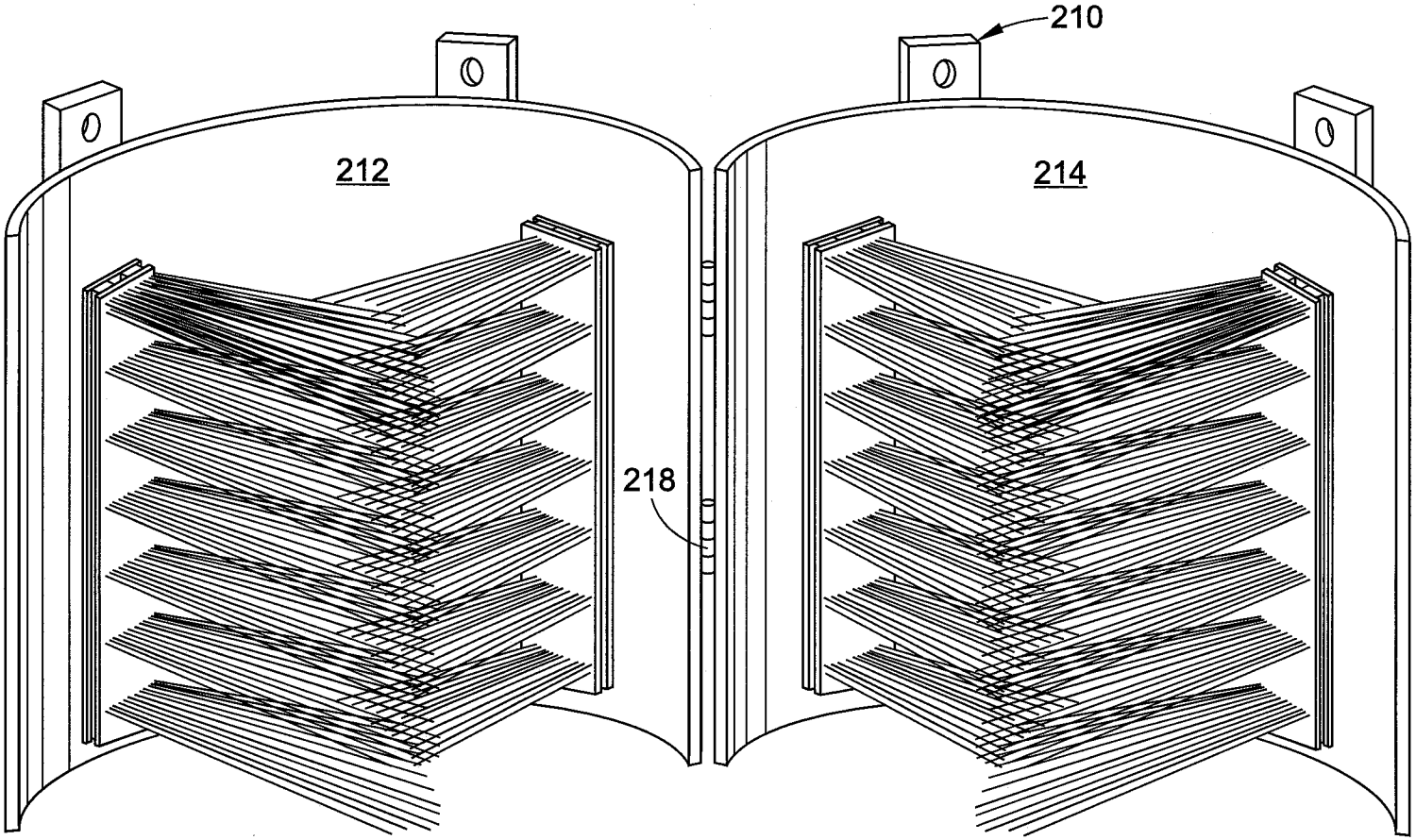
FIG. 9 is a perspective view of a bottom portion of the fire hydrant cleaning system of FIG. 6.

Selectively locking the barrel halves 212 and 214 together are angle iron locks 232 which have bolts 242 extending therethrough. In this embodiment, the barrel halves 212 and 214 are fastened together and subsequently the barrel cap 222 is lowered onto the barrel halves and the barrel cap flanges 240 which are mounted on the barrel halves (FIG. 9) are fastened by bolts 242 in place. Now the housing is ready for use.

With continued reference to FIG. 6, mounted to an inner face of the barrel are a plurality of wire brush holders 270 which each mount bristles 272 that extend inwardly for contact with the fire hydrant. In this embodiment, the wire brush holders 270 are mounted to the interior face of the barrel via fasteners 274.

Figure 8:
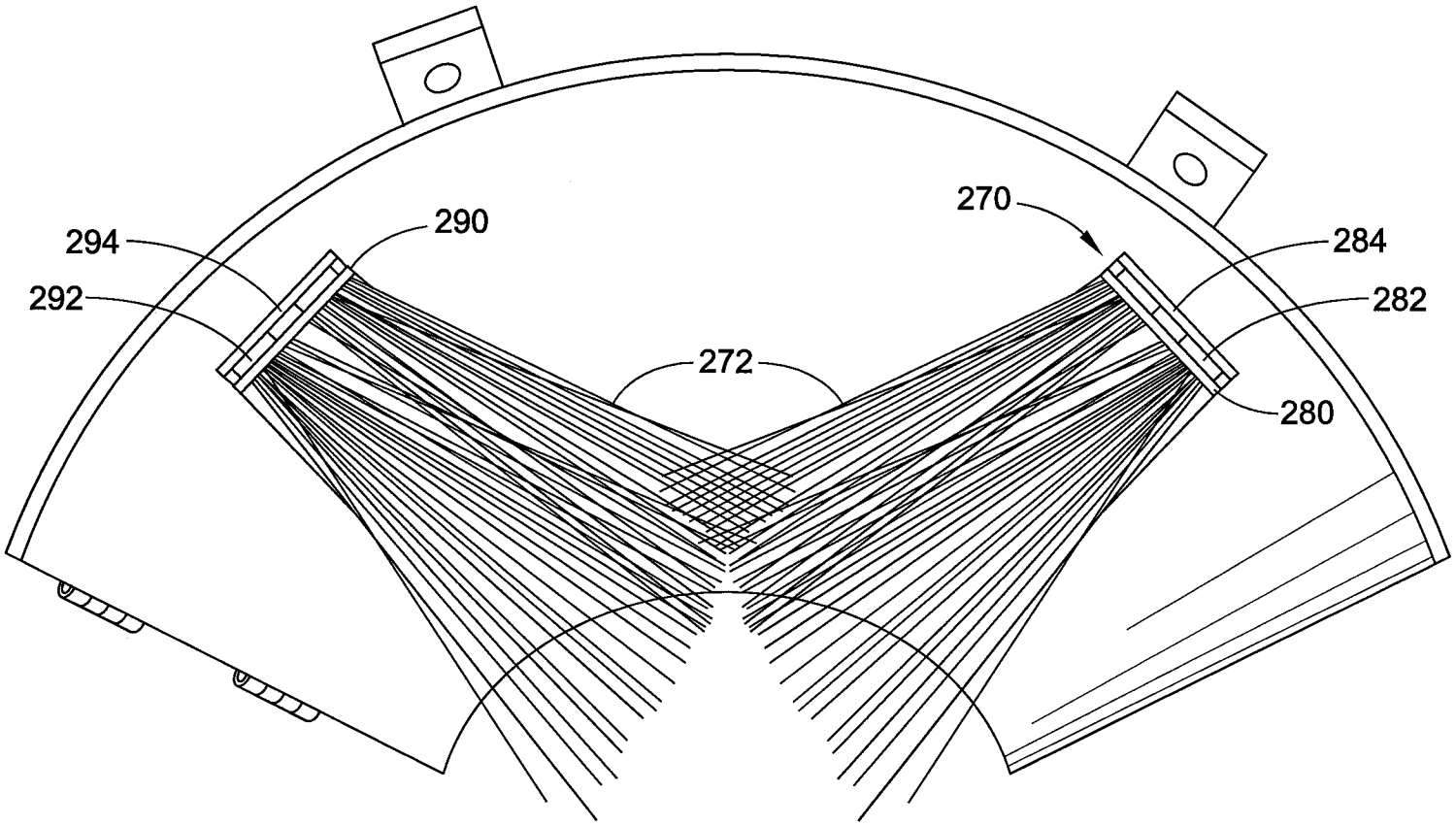
FIG. 8 is a perspective view of an interior of the fire hydrant cleaning system of FIG. 6 on an enlarged scale.

In this embodiment, brush elements, made of a spring steel wire, are provided in a single length but with two different diameters. More particularly, the cleaning members are 11 inches (27.94 cm) in length and include members having a larger diameter of 0.177 inches (0.45 cm) and having a smaller diameter of 0.090 inches (0.23 cm). In the embodiment illustrated in FIG. 8, it can be seen that the larger diameter cleaning members and the smaller diameter cleaning members are held on separate holders 270. Thus, the respective wire holders 270 include respective components as follows. There is provided a small wire plate 280 which is secured via fasteners 282 to a backing plate 284 that is mounted on an interior surface of the barrel. Similarly, there is provided a large wire plate 290 which is mounted via fasteners 292 to a backing plate 294.

Extending through multiple openings in both the small wire plate and the large wire plate are the respective wires or bristles. The openings are sized to accommodate the diameter of wire which is meant to be supported by the small wire plate and the large wire plate respectively. It should be apparent from FIG. 9 that several generally rectangularly shaped such plates are provided. As previously noted, the plates are held in position by suitable fasteners 274. The respective small and large wire plates 280 and 290 trap an elbow shaped section of the plurality of small and large wire bristles between a back side of the plate 280, 290 and a front side of the respective backing plate 284 and 294. The bristles can be gathered in tufts if so desired. In this way, the bristles are held in place for use. It should be appreciated that any desired number of such wire brush holders 270 can be employed and that the wire brush holders can have any desired geometry. Thus, the blocks or wire brush holders can have any desired configuration and size and be provided with any desired or required size of bristle or descaling needle as may be necessary for the task at hand. Moreover, the holders or blocks 270 can be detached and replaced when the bristles become too worn for further use.

Depending downwardly from the plate 252 is a standoff 308 which is meant to contact the top of the fire hydrant to correctly space the cleaning assembly vertically in relation to the top of the fire hydrant.

Figure 10:
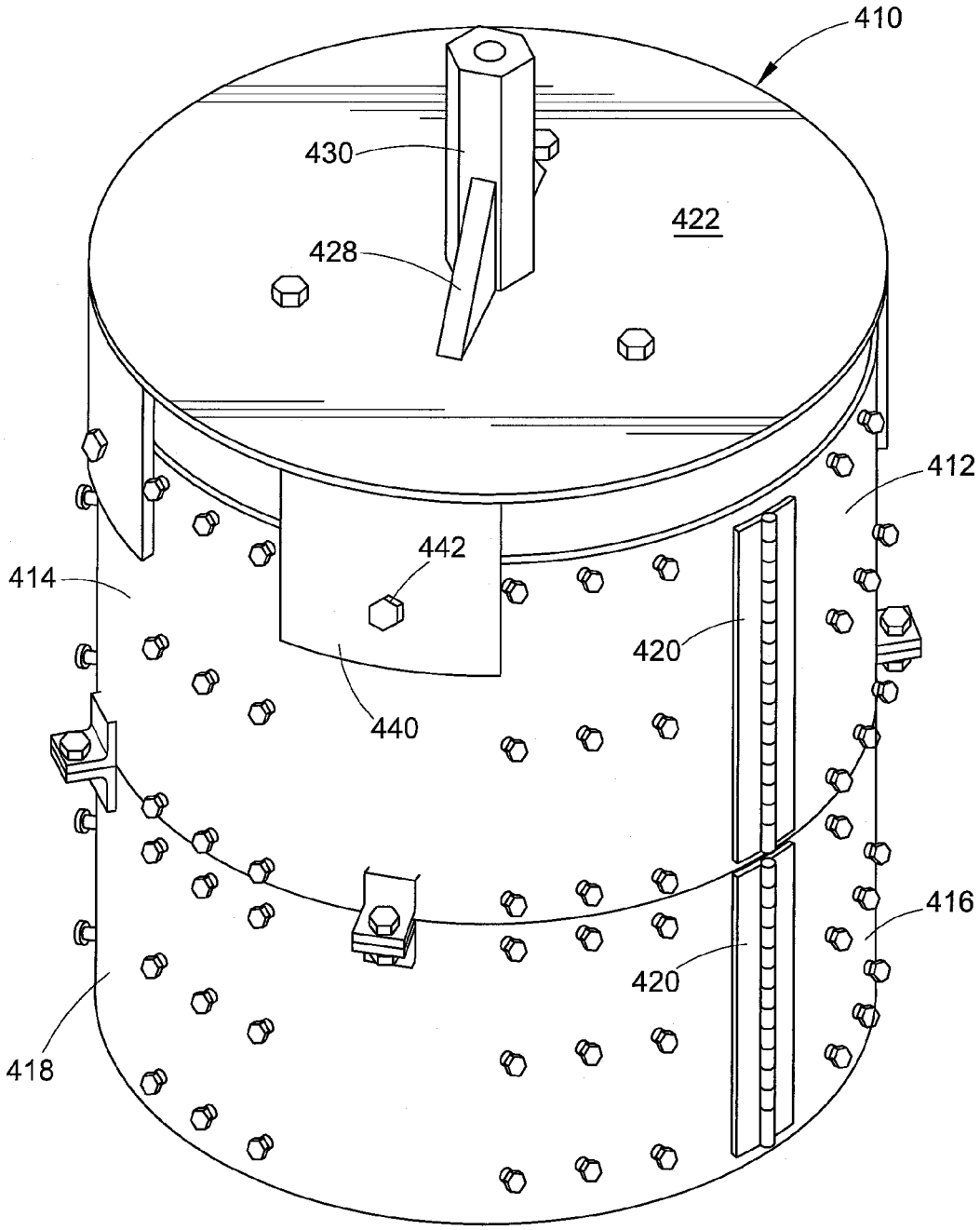
FIG. 10 is a perspective view of a housing for a fire hydrant cleaning system according to a third embodiment of the present disclosure.

With reference now to FIG. 10, still another embodiment of the present disclosure is there illustrated. In this embodiment, a barrel shaped fire plug cleaning device includes the housing 410 comprising first, second, third, and fourth sections 412-418. The first and second sections 412 and 414 are joined via a hinge 420 and the third and fourth sections 416 and 418 are joined via another hinge 420. A barrel cap 422 overlies the housing sections 412-418 and is fastened to the upper two sections 412 and 414 thereof. In this embodiment, bolts 426 or similar fasteners are employed for mounting a plate 452 to a lower surface of the barrel cap 422. Located on an exterior or upper surface of the barrel cap 422 is an arbor attachment 430 which is mounted via arbor gussets 428. The arbor attachment is configured to connect to an output shaft of a suitable known motor (not illustrated in this embodiment) for rotating the housing or barrel in relation to the fire hydrant or other stationary object which is meant to be cleaned. Selectively locking the first and second housing sections 412 and 414 to each other, and the third and fourth housing sections 416 and 418 to each other are angle iron locks 432. These are provided on each of the sections 412-418 at a location opposite the hinges 420 and are fastened to each other via bolts 442 or similar suitable fasteners. To this end, the angle iron locks have apertures through which the bolts 442 extend and the bolts may be secured in place via nuts 444.

The barrel cap 422 is provided with a plurality of spaced barrel cap flanges 440 which are employed to connect the barrel cap to the upper or first and second housing sections 412 and 414 via suitable fasteners 442 that extend through aligned apertures in the respective barrel cap flange and in the respective housing section. Once the several barrel sections are fastened together, the barrel cap 422 can be lowered onto the now joined barrel sections and fastened in place via the bolts 442 in order to provide a housing which is ready for use.

Mounted to an inner face of each of the respective housing sections 412-418 are wire brush assemblies or holders 470.

Figure 13:
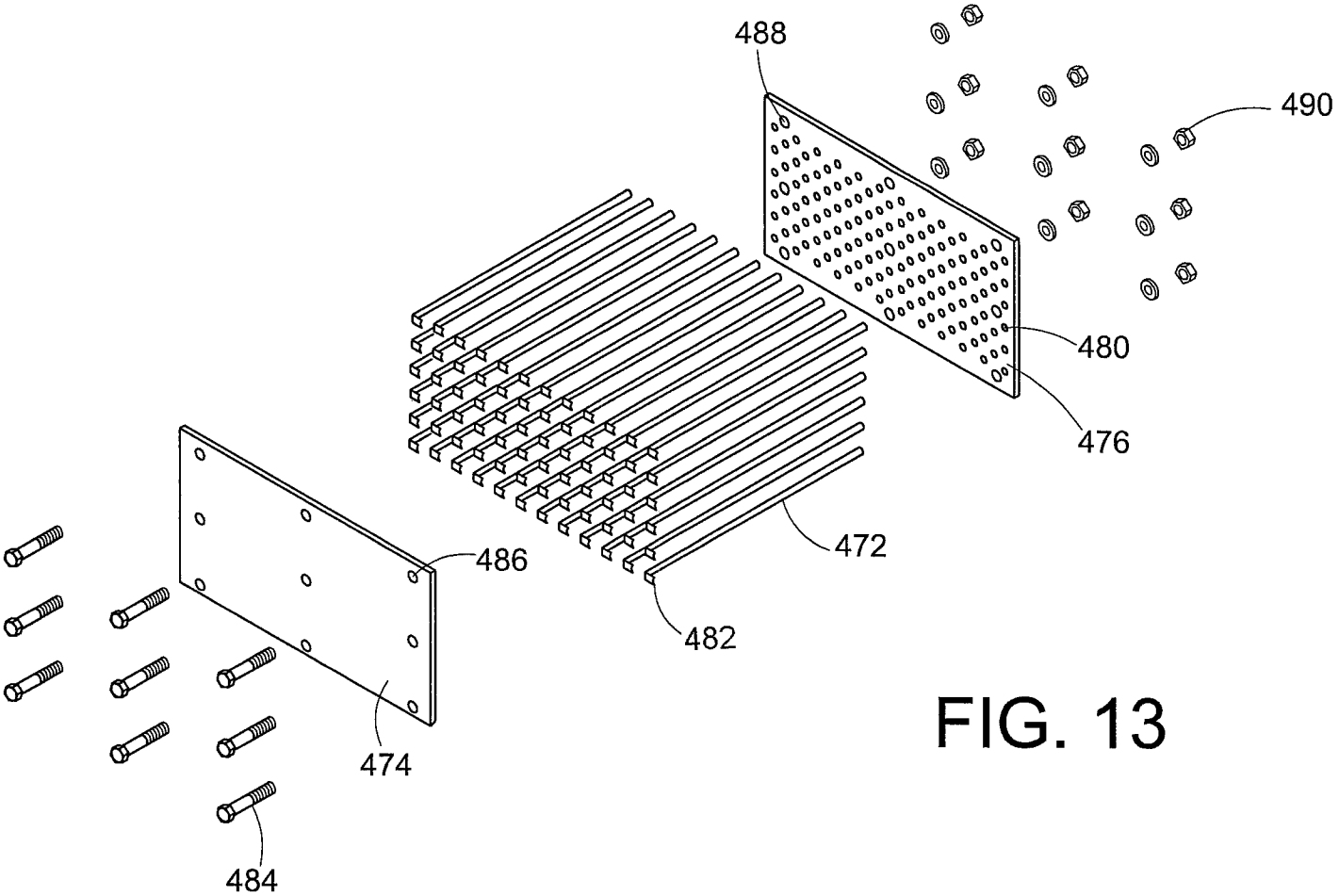
FIG. 13 is an enlarged exploded perspective view of a brush assembly mounted in the housing of FIG. 10.

Each holder includes and plurality of bristles 472. The bristles 472 extend inwardly in the barrel or housing 410 in order to contact the exposed surface of the fire hydrant once the barrel is lowered over the fire hydrant for cleaning purposes. With reference now also to FIG. 13, each of the holders 470 can comprise a first holder plate 474 and a second holder plate 476. The several bristles or descaling needles 472 are arranged so as to extend through respective openings 480 in the second holder plate 476 such that each bristle or descaling needle can have one bent end 482 trapped between the first and second holder plates 474 and 476.

Figure 11:
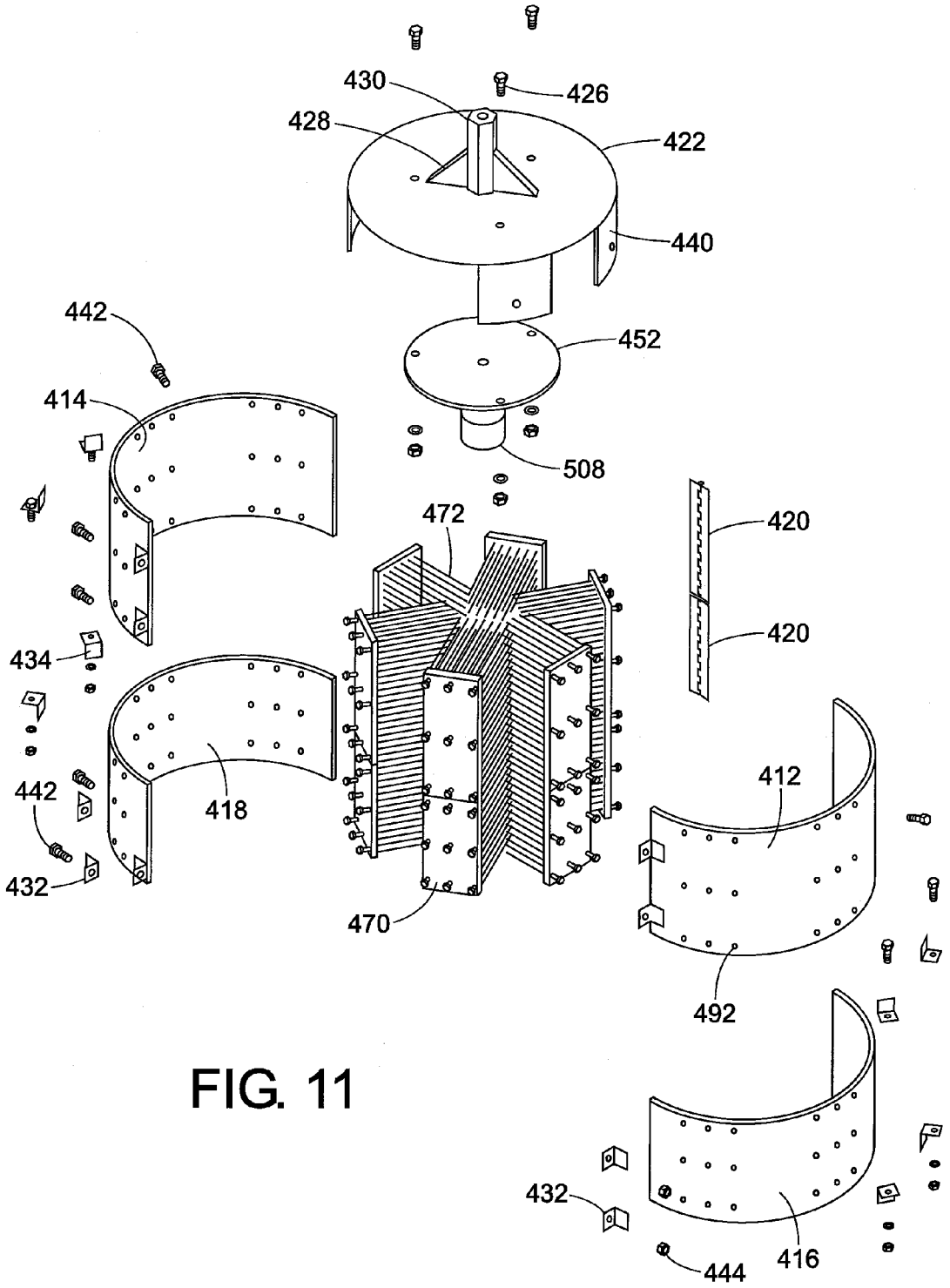
FIG. 11 is an exploded perspective of the housing of FIG. 10.

Suitable fasteners 484 are provided that extend through aligned fastener apertures 486 and 488 in the first and second holder plates 474 and 476 respectively in order to hold the plates together and thus support the bristles. If the fasteners are bolts, they can be secured via nuts 490. It should be appreciated that the respective fasteners 484 also extend through openings 492 in each of the respective housing sections 412-418 in order to securely mount the brush assemblies or wire holders for 470 in place on the housing 410. Thus, the openings or apertures 486, 488 and 492 are aligned in order that a fastener 484 can pass through each aligned set of openings. While the housing sections 412-418 are generally curved, the brush assemblies 470 can be generally planar in configuration as each brush assembly only occupies a limited portion of the circumference of the respective housing section. This can be seen best in FIG. 11 of the instant application's drawings.

Figure 12:
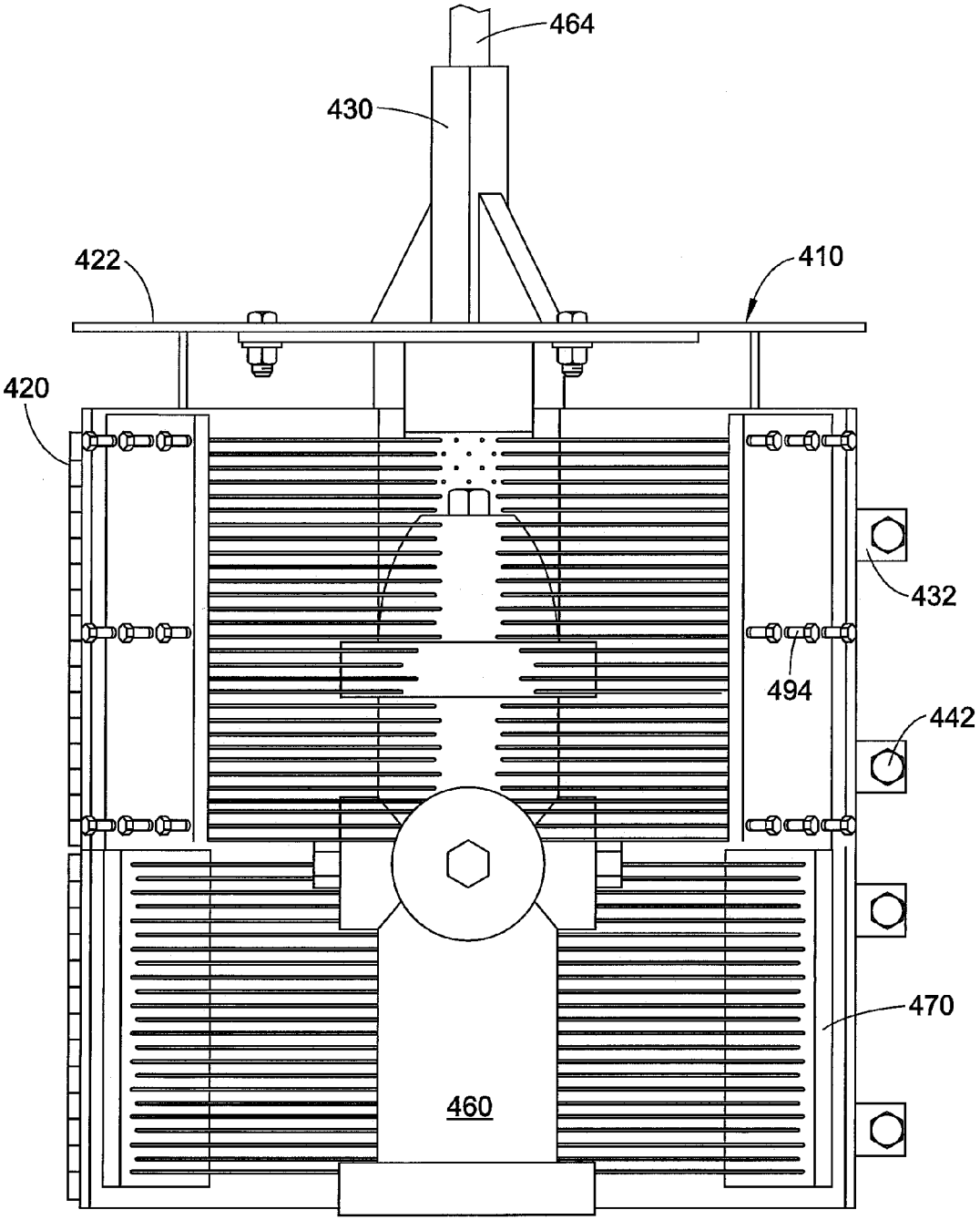
FIG. 12 is a side elevational view in cross section of the housing of FIG. 10 after it has been lowered over a fire hydrant and is thus ready for use.

With reference now to FIG. 12, once the housing or barrel has been assembled, it can be lowered over a fire hydrant 460. Thus, each of the several brush assemblies or wire holders 470 mounted to the barrel contact respective portions of the exposed surface of the hydrant 460. It should be appreciated from FIG. 12 that spacers 494 can be provided between the inner surface of a housing section and a brush assembly as is evident from the upper portion of the housing 410 shown in FIG. 12. In this way, fire hydrants or other stationary objects of varying diameters may be accommodated by the brush assemblies supported by or in the housing 410. Further, fire hydrants of differing heights can be accommodated by either adding or removing the third and fourth sections 416 and 418 of the housing 410. Needless to say the heights and diameters of the several housing sections 412-418 as well as the diameter of the barrel cap 422 can be adjusted as may be necessary to suit any particular intended use of the cleaning device. In order to correctly locate the housing 410 in relation to the fire hydrant 460, a standoff 508 can be secured to a lower face of the plate 452 as is evident from FIG. 12. It should be appreciated that a drive shaft 464 of a motor (not shown) engages the arbor 430 and is connected thereto by known means such as fasteners (not shown) in order to rotate the housing 410 so as to clean the fire hydrant 460.

Disclosed has been a one man cleaning system which could be mounted to a motor vehicle so that an effective and time efficient cleaning of a fire hydrant can take place by a single worker. Also disclosed has been a method for cleaning a fire hydrant in a mechanized manner without the need to employ multiple workers to manually clean the above-ground exterior surface of a fire hydrant or plug, or similar stationary object and without the need for ancillary equipment, such as generators, air compressors, a supply of cleaning material and the like. In addition to the other benefits discussed above, the need for preparation time and cleanup is substantially reduced through the use of the disclosed one man cleaning system because there is no need to set up ancillary equipment or supply cleaning materials and to clean up such materials after the fire hydrant has been cleaned and prepared for painting.

Disclosed has been a vehicle on which is mounted a rotary device for cleaning the fire hydrant. The device includes a generally cylindrically shaped housing. A rotary drive is provided for rotating the housing. Mounted on an interior wall of the housing are a plurality of bristles which extend radially and at various angles into the housing. The bristles can flex to accommodate the contours of the fire hydrant being cleaned.

The disclosure has been described with reference to several embodiments. Obviously, modifications and alterations will occur to others upon a reading and understanding of this specification. It is intended to include all such modifications and alterations in so far as they come within the scope of the appended claims and the equivalence thereof.

What is claimed is:

1. A cleaning apparatus for cleaning an associated stationary object, the apparatus comprising:
- a motor;
- an output drive shaft powered by the motor; and
- a cleaning attachment coupled for rotational movement with the output drive shaft, the cleaning attachment having a generally vertical axis of rotation, the cleaning attachment comprising:
  - a housing including a top wall, a side wall, comprising an outer surface and an inner surface, and an open bottom,
  - a plurality of elongated cleaning members at least some of which are mounted to the side wall inner surface, and
  - a standoff mounted to a lower surface of the top wall and adapted to contact the associated object.

2. The apparatus of claim 1 further comprising a support member to which the motor is mounted.

3. The apparatus of claim 2 wherein the support member comprises a boom which selectively lowers the housing over the associated object.

4. The apparatus of claim 3 wherein the support member further comprises a vehicle.

5. The apparatus of claim 1 wherein the housing side wall includes a first portion, a second portion and a hinge that connects the first portion to the second portion so that the first and second portions are selectively movable in relation to each other.

6. The apparatus of claim 5 further comprising a lock assembly for selectively fastening the housing side wall first portion to the second portion.

7. The apparatus of claim 1 further comprising an arbor connected to an upper surface of the housing top wall, wherein the output drive shaft engages the arbor.

8. The apparatus of claim 1 wherein the elongated cleaning members comprise at least one of bristles and descaling needles.

9. The apparatus of claim 1 wherein at least some of the plurality of elongated cleaning members are mounted to a support.

10. The apparatus of claim 9 wherein the support is removably mounted to the housing.

11. The apparatus of claim 9 wherein the support comprises a first plate and a second plate, which trap between them one end of each elongated cleaning member.

12. The apparatus of claim 1 wherein the plurality of elongated cleaning members includes at least one of cleaning members of different lengths, cleaning members of different diameters and cleaning members made of different materials.

13. A cleaning apparatus for on-site cleaning of a stationary object, comprising:

a housing including an open bottom and a side wall;

a plurality of elongated cleaning members fixedly mounted to each of at least two spaced planar supports which are each removably mounted to an interior surface of the side wall; and a motor for rotating the housing along a generally vertical axis in relation to the associated stationary object.

14. The apparatus of claim 13 further comprising a mechanism for raising and lowering the housing in relation to the associated stationary object.

15. The apparatus of claim 13 wherein the plurality of elongated cleaning members comprise at least one of bristles and descaling needles.

16. The apparatus of claim 13 wherein the housing side wall includes a first portion, a second portion and a hinge that connects the first portion to the second portion so that the first and second portions are selectively movable in relation to each other.

17. The apparatus of claim 16 further comprising a lock assembly for selectively fastening the housing side wall first portion to the second portion.

18. The apparatus of claim 13 wherein the housing further includes a top wall and further comprising an arbor connected to an upper surface of the top wall.

19. The apparatus of claim 13 wherein the plurality of elongated cleaning members includes at least one of cleaning members of different lengths, cleaning members of different diameters and cleaning members made of different materials.

20. A method for cleaning a stationary object comprising:

providing a housing including a side wall and an open bottom, the housing equipped with elongated cleaning members fixedly mounted to spaced supports that are removably mounted to an interior surface of the housing;

lowering the housing over the stationary object;

rotating the housing using a motor; and contacting an exposed surface of the stationary object with the elongated cleaning members.

* * * * *